US005128172A

United States Patent [19]

Whittick

[11] Patent Number: 5,128,172

[45] Date of Patent: Jul. 7, 1992

[54] CONTINUOUS COATING PROCESS WITH INDUCTIVE HEATING

[76] Inventor: Thomas E. Whittick, 4296 Angus Drive, Vancouver, British Columbia, Canada, V6J 4H9

[21] Appl. No.: 596,092

[22] Filed: Oct. 12, 1990

[51] Int. Cl.[5] ..... B05D 3/06

[52] U.S. Cl. ..... 148/526; 427/45.1; 427/321; 427/328; 427/376.8; 427/422; 427/424; 427/427; 427/37; 148/533

[58] Field of Search ..... 427/37, 376.8, 45.1, 427/321, 328, 383.9, 422, 424, 427; 29/527.4; 219/10.71

[56] References Cited

U.S. PATENT DOCUMENTS

| | | | |
|---|---|---|---|
| 2,414,923 | 1/1947 | Batcheller | 117/50 |
| 3,560,239 | 2/1971 | Facer et al. | 117/17 |
| 3,576,664 | 4/1971 | Swartz | 117/93.2 |
| 3,696,503 | 10/1972 | Krengel et al. | 29/527.4 |
| 4,302,483 | 11/1981 | Altorfer et al. | 427/37 |
| 4,411,936 | 10/1983 | Schrewelius | 427/367 |
| 4,595,600 | 6/1986 | Keeven et al. | 427/5 |
| 4,761,530 | 8/1988 | Scherer et al. | 219/10.71 |
| 4,895,736 | 1/1990 | Sommer et al. | 427/45.1 |

FOREIGN PATENT DOCUMENTS

| | | |
|---|---|---|
| 563522 | 9/1958 | Canada . |
| 785572 | 10/1957 | United Kingdom . |
| 834249 | 5/1960 | United Kingdom . |
| 2210064A | 9/1988 | United Kingdom . |

*Primary Examiner*—Bernard Pianalto

*Attorney, Agent, or Firm*—Fay, Sharpe, Beall, Fagan, Minnich & McKee

[57] ABSTRACT

A continuous process for coating a series of workpieces with a metal coating comprises the steps of cleaning the workpieces with a high-pressure water system which utilizes particulates; isolating the workpieces in a non-oxidizing chamber; spraying the workpieces with a wet flux; inductively preheating the workpieces with a pre-heat induction coil; spraying a coating metal onto the surface of the workpieces; inductively heating the workpieces with a main induction coil; and continuously conveying the workpieces through each of the above steps.

6 Claims, 2 Drawing Sheets

CONTINUOUS COATING PROCESS WITH INDUCTIVE HEATING

BACKGROUND OF THE INVENTION

1. Field of Invention

This invention relates to the art of applying coatings to a series of workpieces, and more particularly to a continuous process for fusing a metal coating to a series of metal workpieces, and most particularly to a continuous process for applying a metal coating to a series of metal workpieces and passing the coated workpieces through induction coils to create a fused layer in the outer surface of the workpieces.

2. Description of Related Art

It is often advantageous to provide a coating over the outer surface of an item in order to improve its appearance or performance. For example, automobile bumpers are often coated with a layer of chrome to improve appearance and prevent oxidation. Certain workpieces made of iron are often coated with zinc in order to improve their resistance to oxidation. While the coating of iron workpieces with zinc is well-known, manufacturing difficulties are presented when structural steel shapes, such as channels and angles, are coated with zinc. Conventional methods of coating such large structural steel shapes include "hot-dip" or electrolytic galvanizing. The conventional process requires the repetitive dipping of the entire section or workpiece into large tanks of caustic soda, sulfuric acid, water, and molten zinc. This conventional process essentially achieves only a surface coating with a limited fusion of the zinc into the surface of the structural steel. Finally, the recent numerous governmental pollution control regulations on the electroplating industry require large investments in pollution control equipment to assure compliance.

Hot-dip galvanized zinc coatings have a slight surface degree of alloying reaction compared to the instant invention. The shallow layer of coating is 100% zinc on the surface and, in the best case, a maximum of 75% zinc and 25% iron at the substrate interface. However, in the inventive process herein described, the sprayed metal coating, such as zinc, will be subjected to an alloying process causing the zinc to fuse deeply into the substrate. This gives a uniform zinc-iron alloy to preselected depths. Hotdip galvanizing is dependent almost entirely on the surface thickness of the zinc coating, which is vulnerable compared with a deeply fused layer of alloy. By means of induction heating, a high percentage of heat is generated at the non-ferrous interface, promoting a diffusion not possible in a dipped procedure.

U.S. Pat. No. 2,414,923 to Batcheller discloses a method of coating a metal surface with a second metal by using spray guns which melt a coating metal supplied to the guns in the form of wire. U.K. Patent Application No. GB 2 210 064 A discloses a process for coating a substrate which comprises applying a layer of self-flowing metal-based alloy by thermal spraying and subjecting at least a zone in the layer to inductive heating.

Although these other processes may be technically feasible, they can be commercially unattractive due to cost. It is believed that the present invention will be of lower cost due to its lack of environmental disposal problems as well as the high tonnages capable through the process. Ultimate production rates will be established by operation and calibration, but tonnages greater than hot-dip galvanizing can be achieved at lower cost due the continuous nature of the line. Each of these variables can be controlled by a programmable logic controller, thereby contributing to the continuous nature of the process.

The present invention contemplates an new and improved process which is less expensive, provides a superior product, and does so in a more environmentally safe manner.

SUMMARY OF THE INVENTION

In accordance with the present invention, a new and improved process is provided which is adapted to coat a workpiece with a metal coating.

More particularly, in accordance with the present invention, a continuous process for fusing a metal coating to a series of workpieces is provided, the process comprising the steps of spraying a coating metal onto the surface of the workpieces, inductively heating the workpieces with a main induction coil, and continuously conveying the workpieces through each of the steps.

In accordance with another aspect of the invention, a continuous process for fusing a metal coating to a series of workpieces comprises the steps of cleaning the workpieces, isolating the workpieces in a non-oxidizing chamber, inductively preheating the workpieces with a preheat induction coil, spraying a coating metal onto the surface of the workpieces, inductively heating the workpieces with a main induction coil, and continuously conveying the workpieces through each of the steps.

In accordance with another aspect of the invention, the coating metal is supplied to the process in the form of wires. In accordance with another aspect of the invention, the wires of the coating metal are melted by means of carrying opposed electrical charges of such magnitude as to create an arc and melt the wires.

According to another aspect of the invention, the cleaning of the workpieces is by means of a high-pressure water system which utilizes a series of placed oscillating fan jet nozzles. The high-pressure water system operates at spraying pressures above 2,000 PSI and can operate as high as 35,000 PSI. The high-pressure water system can spray particulates as well as water alone, and by using particulates can remove the outermost surface of the workpieces to provide a contamination-free surface.

According to a further aspect of the invention, the non-oxidizing chamber is an enclosure supplied with an inert gas such as nitrogen so that the enclosure has a pressure slightly above that of atmospheric pressure.

According to another aspect of the invention, the continuous process conveys the workpieces through the steps of the process by means of a roller table. According to one embodiment of the invention, the workpieces progress through the process at a constant speed. According to a still further embodiment of the invention, the speed of the workpieces is controlled by means of a programmable logic controller. According to a still further aspect of the invention, the programmable logic controller is able to vary the intensity of each of the process steps in relation to the surface condition of the workpieces.

According to a still further aspect of the invention, an apparatus for fusing a metal coating to a series of workpieces comprises a plurality of high-pressure water nozzles, a non-oxidizing chamber, means for spraying the workpieces with a wet flux, a first induction coil, means for melting an associated coating metal, means for spraying the associated coating metal onto the surface of the workpieces, a second induction coil, and means for continuously conveying the workpieces.

According to a further aspect of the invention, the workpieces are arranged end to end, so that they present the same cross-sectional shape to the process steps as they progress through the various steps.

According to another aspect of the invention, the different elements of the process, such as the induction coils, the means for spraying the flux and the coating metal, and the water jets are configured so they closely follow the outer peripheral surface of the workpieces.

One advantage of the present invention is lower labor cost. Because of the simplicity of the process, a high degree of automation is possible.

Another advantage of the present invention is the lower environmental costs and operational costs due to a lessening or elimination of the amount of environmentally hazardous materials which must be disposed.

Another advantage of the present invention is the increased safety to the environment as well as to the workers implementing the process. Because no dangerous chemicals are used, medical costs, insurance costs, and worker job dissatisfaction should decrease.

Another advantage of the present invention is the improved performance of the workpieces themselves. Because the metal coating forms an alloy with the material of the workpieces to a prescribed depth, the advantages of the coating are more uniform and longlasting than in other processes. The depth of the alloy formed may be controlled by the amount of coating applied and the time, temperature, and frequency of the induction heating used.

Another advantage of the present invention is lower cost due to the increased tonnages believed possible by the continuous nature of the process.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof and wherein.

DESCRIPTION OF THE PREFERRED EMBODIMENT

Figure 1:
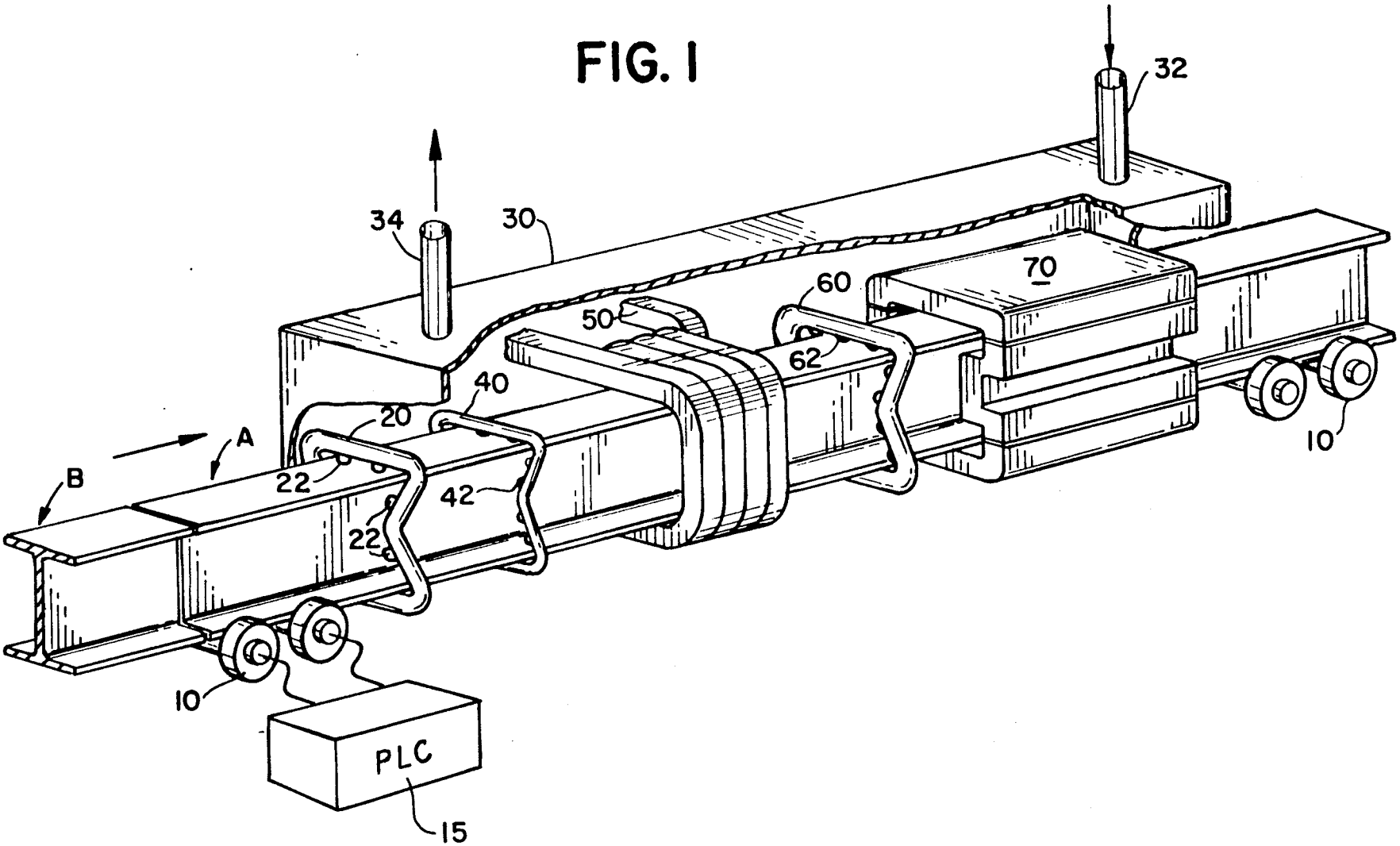
FIG. 1 is a schematic perspective view of the preferred embodiment of the process according to the present invention.

Referring now to the drawings wherein the showings are for purposes of illustrating a preferred embodiment of the invention only, and not for purposes of limiting same, FIG. 1 shows a schematic representation of the preferred embodiment of the process. A first discrete workpiece A is being conveyed through the process by a material handling conveyor system 10. In the preferred embodiment, the material handling system is a driven roll conveyor. In the case of a workpiece in the form of a sheet of steel, the material handling conveyor system 10 may take the form of a chain drive from which brackets are hung. The brackets would attach to the steel sheets and support them through the process sequence. In such case, the top portion of the non-oxidizing chamber 30 would feature a gasketed slot.

Preferably, the workpiece A progresses through the steps of the process at a constant velocity. In the preferred embodiment, the constant velocity is maintained by means of a programmable logic controller 15. In the preferred embodiment, the programmable logic controller 15 adjusts the intensity of the process steps in relation to the surface condition of the workpiece. For example, if the surface of the workpiece is especially dirty, the programmable logic controller 15 will increase the intensity of the cleaning step to compensate for the poor condition of the surface of the workpiece A. The intensity may be increased by raising the pressure of the water exiting the nozzles, increasing the percentage of particulate matter in the water, or by slowing the process down to allow enough time to properly clean the workpiece. Preferably, means other than the decreasing of the process speed is used to compensate for surface conditions.

Immediately behind the first workpiece A is a second workpiece B. The workpieces have been arranged so that they are "end to end" or "butt to butt". This arrangement presents a uniform cross-sectional shape to the elements of the process. As will be discussed later, the different elements of the process have been configured to closely correspond to the shape of the outer periphery of the workpiece. It is necessary that the workpieces are presented to the process elements in a consistent manner to allow for the continuous and automatic nature of the process. However, it is not necessary that the end of one workpiece be closely adjacent to the end of the next workpiece. In fact, in some applications, some advantages may be obtainable by separating the workpieces by sufficient distance to allow coating of the ends of the workpiece.

The workpiece A shown in the embodiment above is a structural steel member commonly known as an "I-beam". The system can be configured for other structural steel shapes, or other shapes which are not necessarily standardized structural steel shapes. For example, it is believed that the process can be configured to provide coatings or platings on items such as roadway lamp support posts which may have unusual shapes. It is also possible to configure the system to coat rectangular sheets of steel, with dimensions such as four feet by eight feet.

The first step of the process is a cleaning step. The cleaning step removes oxides, mill scale, and other contaminants from the surface of the workpiece A. Previously, this cleaning was accomplished chemically through caustic soda, sulfuric acid, and other environmentally dangerous materials.

The current invention utilizes a high-pressure water system 20 which utilizes a series of placed, oscillating fan jet nozzles 22. The water is supplied at pressures between 2,000 PSI and 35,000 PSI. In the preferred embodiment, these pressures are generated by means of a two stage pump and intensifier unit (not shown). If necessary, the high-pressure water spray will be augmented with particulate matter, such as sand or other natural and artificial particulates, for cleaning of especially tough surfaces. If the surface is contaminated, such as by oxidation or mill scale, the high-pressure water system, especially when augmented with particulate matter, is able to remove the outermost surface of the workpiece A to insure a clean, non-oxidized surface for the subsequent steps of the process. Generally, pressures within the above-mentioned ranges are sufficient to clean even the most oxidized workpieces. The use of this high-pressure water system 20 is of great value from an environmental standpoint. Instead of disposing of barrels of caustic soda or sulfuric acid, the byproducts of this process are simply water and particulate.

The remaining steps of the process take place in a non-oxidizing chamber 30 which is continuously charged at a minimal pressure. The non-oxidizing chamber 30 is supplied with an inert gas at a pressure slightly above atmospheric pressure. The gas enters the oxidizing chamber at inlet 32 and exits at outlet 34. In the preferred embodiment, the inert gas is nitrogen. Inlet and outlet slots (not shown) of the non-oxidizing chamber 30 are configured to match the conveyed shape. The workpiece is moved along a central axis of the chamber. The non-oxidizing atmosphere helps insure that the newly cleaned surface of the workpiece A remains free from oxidation until coated later in the process.

In the preferred embodiment, the next step of the process is the application of a wet flux by a series of spray nozzles 42 mounted on a jig 40. Preferably, the flux solution, for purposes of example, will be a water solution of 45% ammonium chloride and 55% zinc chloride. The exact solution of the flux will be selected for each application, depending on the sprayed material, workpiece material, and other process parameters. The preferred flux will be vaporized at 600° F. to 650° F., the temperature is generated by the preheat induction coil 50. The jig 40 is configured to closely correspond to the shape of the outer periphery of the workpiece A.

The next step of the preferred embodiment of the process is a drying and preheating stage. The wet flux is dried and the workpiece is inductively preheated to approximately 600° F. to 650° F. by means of a preheat induction coil 50. The workpiece is heated to this temperature to vaporize the flux.

The next step of the process is the coating step. In the preferred embodiment of the process, the coating metal is melted and then sprayed onto the outer surface of the workpiece A through a process known as thermal spray. "Thermal spray" is a generic term for a group of commonly used processes for depositing metallic and non-metallic coatings. These processes, sometimes also known as metalizing, are flame spray, plasma arc spray, and electric arc spray. Coatings can be sprayed from rod or wire stock, or from powdered material. In the form of wire or rod, material is fed into a flame axially from the rear, where it is melted. The molten stock is then stripped from the end of the wire or rod and atomized by a high velocity stream of compressed gas which propels the material onto a prepared substrate or workpiece.

In the preferred embodiment, the coating metal is supplied to the process in the form of two wires, which are then melted by the electric arc spray technique. The wires 100 are supplied with opposing electrical charges of sufficient magnitude, and the wires 100 are located in such proximity, that an electrical arc forms between the two wires 100. The formation of this arc melts the wires into a molten state. The molten material is sprayed onto the workpiece by means of compressed inert gas. In the preferred embodiment, the gas is nitrogen.

Figure 2:
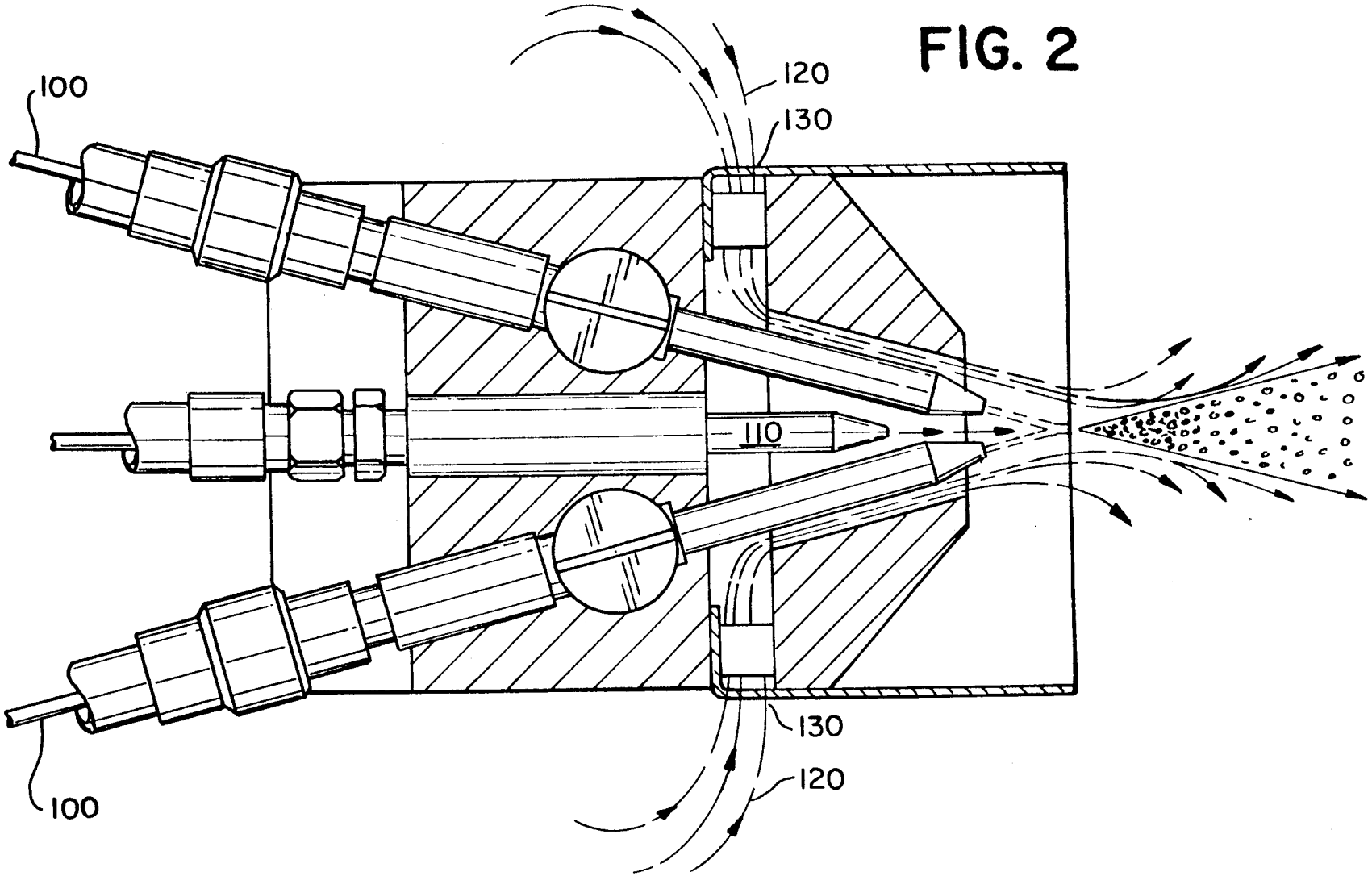
FIG. 2 is a schematic plan view of an apparatus utilized to melt the coating material.

The preferred mechanism is illustrated in FIG. 2. Two wires 100, for example of zinc, are fed through an apparatus and positioned in the proper proximity to create the electric arc. Compressed air is supplied through a nozzle 110. Additional cooling and shielding air 120 is supplied through orifices 130.

With reference to FIG. 1, the spray is directed by means of a jig 60 and nozzles 62. The depth of the coating may be monitored by the programmable logic controllers and depends on the volume of molten coating material being sprayed and the speed of the workpiece through the process. In the preferred embodiment, the thickness of the molten metal coating is between 0.5 millimeters and 7.0 millimeters. The jig 60 is configured to closely correspond to the outer periphery of the workpiece A.

The next step of the process is the alloying step. A main induction coil 70 heats the coating and the workpiece A for a sufficient time and temperature, and at such induction current frequency to form an alloy of the coating material and the material of the workpiece. It is believed that this process will result in superior control of the end product in that the depth of the alloying will be dependent on the selection of the induction frequency, the shape of the inductors, the speed through the process line, the amount of the coating sprayed, and the temperature of the process. In a common application of the preferred process, an iron structural steel shape is coated with zinc to create an alloy in the outer surface of the workpiece, the alloy having a macroscopically homogeneous mixture between the zinc and the iron atoms. The alloy is much more resistant to corrosion than the iron itself.

If desired, a quenching step, such as with air or water, can be added at this point.

The present invention thus disclosed is an improved process for coating a workpiece with a coating in a continuous manner. The invention has been described with reference to a preferred embodiment. Obviously, modifications and alterations will occur to others upon a reading and understanding of the specification. It is intended to include all such modifications and alterations insofar as they come within the scope of the appended claims or the equivalents thereof.

Having thus described the invention, it is now claimed:

1. An automated, continuous process for applying a layer of zinc to workpieces, the continuous process comprising the steps of:

cleaning the surface of the workpieces by means of high-pressure water, the high-pressure water being sprayed against the surface of the workpieces by a series of oscillating fan jet nozzles;

conveying the workpieces into a non-oxidizing chamber which includes a supply of an inert gas at a pressure above atmospheric pressure;

spraying the workpieces with a wet flux;

inductively preheating the workpieces and drying the flux by passing the workpieces through a preheat induction coil;

propelling a stream of molten metal against the surface of the workpieces, the molten metal being melted by means of an electric arc between two electrically opposed wires of the metal and being propelled by a stream of compressed inert gas;

inductively heating the workpieces by means of main induction coil at a temperature and for a time sufficient to create an alloy in the surface of the workpiece; and, performing the above processor steps in a continuous manner.

2. A continuous process for galvanizing a layer of zinc coating to a series workpieces, said workpieces being structural steel ad iron shapes such as I-beams or channels, said workpieces having similar or identical cross-sections, said process comprising the steps of:

conveying a first workpiece into a cleaning apparatus, said cleaning apparatus comprising a series of high pressure water nozzles which spray water on said first workpiece at very high pressures;

cleaning an outer layer of said first workpiece by spraying water at very high pressures, said spraying removing contaminates from an outer surface of said first workpiece;

drying and preheating said first workpiece by a first induction coil, said preheating raising the temperature of said first workpiece to between 600° F. and 650° F;

coating said outer surface of said first workpiece with a layer of zinc, said layer of zinc being sprayed onto said first workpiece via thermal spraying, said layer of zinc having a thickness of between 0.5 millimeters and 7.0 millimeters;

alloying said layer of zinc to said first workpiece by passing said first workpiece through a second induction coil, said second induction coil heating said first workpiece and said layer of zinc until an alloy is formed in said outer layer of said first workpiece;

repeating said foregoing steps in a continuous manner with a second workpiece, said second workpiece being substantially identical to said first workpiece, said second workpiece oriented to said first workpiece in an end-to-end manner and following directly behind said first workpiece through said process.

3. A continuous process as in claim 2 wherein the conveyance of said first workpiece through said process is controlled by means of a programmable logic controller, said programmable logic controller capable of varying the intensity of some of the steps of said process in relation to a surface condition of said first workpiece.

4. The process of claim 2 wherein said high pressure water nozzles are oscillating fan jet nozzles.

5. The process of clam 2 wherein said high pressure water nozzles spray water and particulates.

6. The process of claim 2 wherein the steps of cleaning, drying, preheating, coating, and alloying are carried out in a non-oxidizing chamber, said chamber being an enclosure supplied with pressurized inert gas.

* * * * *

UNITED STATES PATENT AND TRADEMARK OFFICE

CERTIFICATE OF CORRECTION

PATENT NO. : 5,128,172

DATED : July 7, 1992

INVENTOR(S) : Thomas E. Whittick

It is certified that error appears in the above-identified patent and that said Letters Patent is hereby corrected as shown below:

Claim 1, column 7, line 3, delete "processor" and replace with --process--.

Claim 2, column 7, line 7, delete "ad" and replace with --and--.

Signed and Sealed this

Twenty-fourth Day of August, 1993

Bruce Lehman

*Attest:*

BRUCE LEHMAN

*Attesting Officer*

*Commissioner of Patents and Trademarks*